US008440378B2

(12) United States Patent
Takahashi et al.

(10) Patent No.: US 8,440,378 B2
(45) Date of Patent: May 14, 2013

(54) ELECTROSTATIC IMAGE DEVELOPING TONER, METHOD FOR PRODUCING ELECTROSTATIC IMAGE DEVELOPING TONER, METHOD FOR FORMING IMAGE, AND IMAGE FORMING APPARATUS

(75) Inventors: Masaru Takahashi, Kanagawa (JP); Shinya Nakashima, Kanagawa (JP); Shuji Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 12/862,247

(22) Filed: Aug. 24, 2010

(65) Prior Publication Data

US 2011/0236817 A1 Sep. 29, 2011

(30) Foreign Application Priority Data

Mar. 26, 2010 (JP) ..... 2010-071932

(51) Int. Cl.
*G03G 9/00* (2006.01)

(52) U.S. Cl.
USPC ..... 430/108.3; 430/108.1; 430/109.1; 430/109.4

(58) Field of Classification Search ..... 430/108.1, 430/108.2, 108.22, 108.24, 108.3, 108.7, 430/109.1, 109.4
See application file for complete search history.

(56) References Cited

U.S. PATENT DOCUMENTS

| | | | | |
|---|---|---|---|---|
| 5,478,686 | A * | 12/1995 | Kawakami et al. | 430/109.4 |
| 5,876,894 | A * | 3/1999 | Leclair | 430/108.2 |
| 6,350,552 | B1 * | 2/2002 | Livengood et al. | 430/108.22 |
| 2004/0137357 | A1 * | 7/2004 | Bartel et al. | 430/137.14 |
| 2006/0051691 | A1 * | 3/2006 | Nakajima et al. | 430/108.1 |
| 2006/0051694 | A1 | 3/2006 | Aoki | |
| 2006/0057482 | A1 * | 3/2006 | Yuasa | 430/108.2 |

FOREIGN PATENT DOCUMENTS

| | | |
|---|---|---|
| JP | A-9-265206 | 10/1997 |
| JP | A-10-301334 | 11/1998 |
| JP | A-2006-72094 | 3/2006 |

* cited by examiner

*Primary Examiner* — Stewart Fraser
(74) *Attorney, Agent, or Firm* — Oliff & Berridge, PLC

(57) ABSTRACT

An electrostatic image developing toner includes a binding resin and a release agent, wherein an organic silicon compound including a siloxane bond is present in a domain of the release agent.

9 Claims, 1 Drawing Sheet

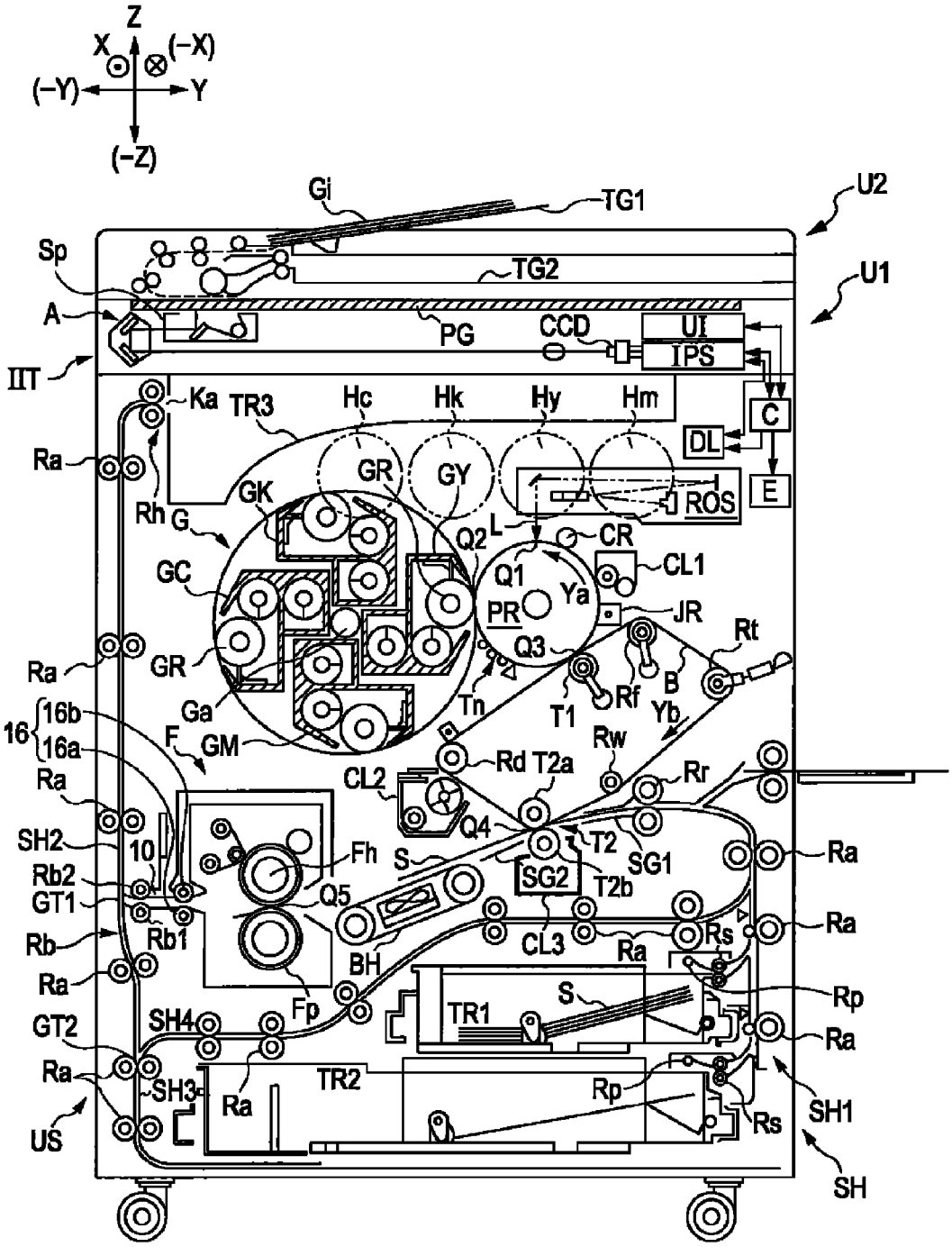
Z
X
(-X)
(-Y)
Y
(-Z)
Gi
TG1
U2
Sp
TG2
U1
A
PG
CCD
UI
IPS
IIT
Ka
TR3
Hc
Hk
Hy
Hm
C
DL
E
Ra
GR
GY
ROS
Rh
G
GK
Q2
L
CR
GC
Q1
CL1
Ya
PR
JR
Rt
Q3
Ra
GR
Rf
B
Ga
Tn
T1
Yb
16
16b
16a
F
GM
Rw
Rd
T2a
Rr
Ra
CL2
Q4
SH2
10
Fh
S
T2
SG1
Ra
Rb2
SG2
T2b
GT1
Q5
Rb1
Rs
Ra
Rb
CL3
Ra
BH
Ra
S
Rp
Fp
TR1
GT2
SH4
Ra
Ra
TR2
Rp
SH3
Ra
Rs
SH1
US
SH

ELECTROSTATIC IMAGE DEVELOPING TONER, METHOD FOR PRODUCING ELECTROSTATIC IMAGE DEVELOPING TONER, METHOD FOR FORMING IMAGE, AND IMAGE FORMING APPARATUS

CROSS-REFERENCE TO RELATED APPLICATIONS

This application is based on and claims priority under 35 USC 119 from Japanese Patent Application No. 2010-071932 filed Mar. 26, 2010.

BACKGROUND (i) Technical Field

The present invention relates to an electrostatic image developing toner, a method for producing an electrostatic image developing toner, a method for forming an image, and an image forming apparatus.

(ii) Related Art

In the formation of an image by an electrophotographic process, when duplicating an image, an electrostatic latent image is formed on a photoconductor body including a photoconductive material; the electrostatic latent image is developed as a toner image by making toner adhere to the electrostatic latent image by a magnetic brush developing technique or the like; the toner image on the photoconductor body is transferred onto a recording material (transfer material) such as paper or a sheet; and the toner image is then fixed by heat, a solvent, pressure, or the like and a permanent image is thus provided.

As for a technique of fixing such a toner image, a heat melting system is most commonly used. Heat melting systems are broadly divided into contact heat melting systems and noncontact heat melting systems. In particular, when a contact heating roller fixing system is used, thermal efficiency is high and fixing is rapidly performed. Accordingly, such a system has been widely used in commercial copiers, printers, and the like in recent years.

As a heating roller used in such a contact heating roller fixing system, to suppress adhesion of molten toner to the roller upon fixing of toner by heat, a heating roller in which a release layer composed of a material having a low surface energy such as a fluorocarbon resin is formed as a roller surface layer has been used. Thus, materials used for forming such roller surface layers have been restricted. In addition, when such a resin is worn away or damaged due to repeated use of such a fixing roller, there are cases where the wettability of the surface of the fixing roller is not maintained for a long period of time with stability.

SUMMARY

According to an aspect of the invention, there is provided an electrostatic image developing toner including a binding resin; and a release agent, wherein an organic silicon compound including a siloxane bond is present in a domain of the release agent.

BRIEF DESCRIPTION OF THE DRAWING

Exemplary embodiments of the present invention will be described in detail based on the following FIGURE, wherein:

FIGURE is a schematic sectional view illustrating an example of an image forming apparatus according to an exemplary embodiment.

DETAILED DESCRIPTION

Hereinafter, exemplary embodiments will be described.

Electrostatic Image Developing Toner

An electrostatic image developing toner (hereafter, also simply referred to as "toner") according to an exemplary embodiment includes a binding resin and a release agent, wherein an organic silicon compound including a siloxane bond is present in a domain of the release agent.

In exemplary embodiments, a description "A to B" includes a range from A to B and represents the range from A to B including A and B, which are two ends of the range. For example, when a value is "A to B", the value is "A or more and B or less" or "B or more and A or less".

Compared with the above-described heating roller in which a release layer composed of a material having a low surface energy is formed as a surface layer, a heating roller (heating member) composed of a metal and not including such a release layer serving as a surface layer has an advantage of excellent wear resistance in repeated use of the heating roller.

However, a heating roller composed of a metal and not including a release layer serving as a surface layer has a high surface energy. Accordingly, a toner has been configured to discharge a large amount of a release agent in order to suppress offset of the toner to the roller. In such a case where a large amount of a release agent is discharged, a portion of the discharged release agent adheres to a heating roller and then migrates onto a recording medium (transfer material) such as a paper sheet on which an image has been subsequently formed. Then, the release agent contaminates a feed roller that transports the recording medium. As a result, the feed roller suffers from variation or unevenness in the coefficient of friction and there have been cases where malfunction tends to occur during continuous use.

In a toner according to an exemplary embodiment, an organic silicon compound including a siloxane bond is present in a domain of a release agent. In such a case, when at least the uppermost surface layer of a heating roller has a high surface energy of $30\times10^{-3}$ N/m or more or about $30\times10^{-3}$ N/m or more as in a heating roller composed of a metal and not including a release layer serving as a surface layer, the release agent has a high affinity for the heating roller and the contact angle between the release agent being molten and the heating roller is 50° or less or about 50° or less.

Accordingly, the release agent having been discharged from the toner uniformly spreads over the heating roller due to high affinity. In addition, migration of the release agent onto a recording medium such as a paper sheet on which an image has been subsequently formed is reduced. Thus, contamination of a feed roller that transports a recording medium on which an image has been formed due to a release agent is suppressed and malfunction during continuous operation is suppressed.

Hereinafter, constituent materials of a toner, a method for producing a toner, and the like according to an exemplary embodiment will be described.

Binding Resin

A toner according to an exemplary embodiment at least contains a binding resin.

Examples of the binding resin include homopolymers and copolymers of styrenes such as styrene and chlorostyrene; monoolefins such as ethylene, propylene, butylene, and isoprene; vinyl esters such as vinyl acetate, vinyl propionate, vinyl benzoate, and vinyl acetate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone.

In particular, representative examples of such binding resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene. Furthermore, examples of such binding resins include polyester resins, polyurethane resins, epoxy resins, silicone resins, polyamide resins, modified rosins, paraffins, and waxes. Of these, in particular, use of a polyester resin as a binding resin is effective.

A polyester resin used in an exemplary embodiment is synthesized by polycondensation of a polyol component and a polycarboxylic acid component. In an exemplary embodiment, such a polyester resin may be a commercially available product or, if necessary, a polyester resin having been synthesized.

Examples of such a polyhydric carboxylic acid component include, but are not limited to, oxalic acid, aliphatic dicarboxylic acids such as succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as dibasic acids such as phthalic acid, isophthalic acid, terephthalic acid, naphthalene-2,6-dicarboxylic acid, malonic acid, and mesaconic acid; anhydrides of the foregoing; and lower alkyl esters of the foregoing.

Examples of a carboxylic acid that is trihydric or more include 1,2,4-benzenetricarboxylic acid, 1,2,5-benzenetricarboxylic acid, and 1,2,4-naphthalenetricarboxylic acid; anhydrides of the foregoing; and lower alkyl esters of the foregoing. These carboxylic acids may be used alone or in combination of two or more thereof.

A polyester resin used in an exemplary embodiment may include, in addition to such an aliphatic dicarboxylic acid or an aromatic dicarboxylic acid, a dicarboxylic acid component including an ethylenic unsaturated double bond. Such a dicarboxylic acid including an ethylenic unsaturated double bond, which is radically crosslinkable through the ethylenic unsaturated double bond, is suitably used in order to suppress hot offset upon fixing. Examples of such a dicarboxylic acid include, but are not limited to, maleic acid, fumaric acid, 3-hexenedioic acid, and 3-octenedioic acid; lower esters of the foregoing; and anhydrides of the foregoing. Of these, fumaric acid, maleic acid, and the like may be used in view of cost.

As for such a polyhydric alcohol component, examples of a polyhydric alcohol that is dihydric include alkylene (2 to 4 carbon atoms) oxide adducts (average added moles: 1.5 to 6) of bisphenol A such as polyoxypropylene(2.2)-2,2-bis(4-hydroxyphenyl)propane and polyoxyethylene(2.2)-2,2-bis(4-hydroxyphenyl)propane, ethylene glycol, propylene glycol, neopentyl glycol, 1,4-butanediol, 1,3-butanediol, and 1,6-hexanediol.

Examples of a polyhydric alcohol that is trihydric or more include sorbitol, pentaerythritol, glycerol, and trimethylolpropane.

As for an amorphous polyester resin (also referred to as "noncrystalline polyester resin"), among the above-described raw material monomers, a secondary alcohol that is dihydric or more and/or an aromatic carboxylic acid compound that is dihydric or more is preferred. Examples of such a secondary alcohol that is dihydric or more include propylene oxide adducts of bisphenol A, propylene glycol, 1,3-butanediol, and glycerol. Of these, propylene oxide adducts of bisphenol A are preferred.

Examples of an aromatic carboxylic acid compound that is dihydric or more include terephthalic acid, isophthalic acid, phthalic acid, and trimellitic acid. Of these, terephthalic acid and trimellitic acid are preferred.

In particular, resins having a softening point of 90° C. to 150° C. or about 90° C. to about 150° C., a glass transition temperature of 50° C. to 75° C., a number average molecular weight of 2,000 to 10,000, a weight average molecular weight of 8,000 to 150,000 or about 8,000 to about 150,000, an acid value of 5 to 30 mgKOH/g, and a hydroxyl value of 5 to 40 mgKOH/g are preferably used.

To impart low-temperature fixability to a toner, a crystalline polyester resin may be used as a portion of a binding resin.

Such a crystalline polyester resin may be formed from an aliphatic dicarboxylic acid and an aliphatic diol and is preferably formed from a linear dicarboxylic acid whose backbone chain portion contains 4 to 20 carbon atoms and a linear aliphatic diol whose backbone chain portion contains 4 to 20 carbon atoms. When such components are linear, the resultant polyester resin has excellent crystallinity and an appropriate crystalline melting point and hence the toner is excellent in terms of resistance to toner blocking, image preservability, and low-temperature fixability. When such components contain 4 or more carbon atoms, the toner has a low concentration of ester bonds, an electrical resistance of an appropriate value, and excellent toner electrification property. When such components contain 20 or less carbon atoms, such materials are practically readily available. The number of such carbon atoms is preferably 14 or less.

Examples of an aliphatic dicarboxylic acid that is suitably used for the synthesis of a crystalline polyester resin include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid; lower alkyl esters of the foregoing; and acid anhydrides of the foregoing. Of these, sebacic acid and 1,10-decanedicarboxylic acid are preferred in consideration of availability.

Specific examples of an aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Of these, 1,8-octanediol, 1,9-nonanediol, and 1,10-decanediol are preferred in consideration of availability.

Examples of an alcohol that is trihydric or more include glycerin, trimethylolethane, trimethylolpropane, and pentaerythritol. These alcohols may be used alone or in combination of two or more thereof.

In the polyhydric carboxylic acid component, the content of an aliphatic dicarboxylic acid is preferably 80 mol % or more and, more preferably, 90 mol % or more. When the content of an aliphatic dicarboxylic acid is 80 mol % or more, the polyester resin has excellent crystallinity and an appropriate melting point and hence the toner is excellent in terms of resistance to toner blocking, image preservability, and low-temperature fixability.

In the polyhydric alcohol component, the content of such an aliphatic diol is preferably 80 mol % or more and, more preferably, 90 mol % or more. When the content of the aliphatic diol is 80 mol % or more, the polyester resin has excellent crystallinity and an appropriate melting point and hence the toner is excellent in terms of resistance to toner blocking, image preservability, and low-temperature fixability.

If necessary, for example, in order to adjust an acid value or a hydroxyl value, a monohydric acid such as acetic acid or benzoic acid or a monohydric alcohol such as cyclohexanol or benzyl alcohol is used.

A method for producing such a polyester resin is not particularly restricted. Such a polyester resin may be produced by a standard polyester polymerization technique in which a reaction between an acid component and an alcohol component is caused, for example, direct polycondensation, transesterification, or the like. A polyester resin may be produced by such a technique selected in accordance with the type of monomers.

A polyester resin may be produced by subjecting such a polyhydric alcohol and a polyhydric carboxylic acid to a condensation reaction in a standard manner. For example, such a polyhydric alcohol and a polyhydric carboxylic acid and, if necessary, a catalyst, are charged into a reaction vessel equipped with a thermometer, a stirrer, and a falling condenser and heated to 150° C. to 250° C. in the presence of an inert gas (nitrogen gas or the like). Low-molecular-weight compounds generated as by-products are continuously removed from the reaction system to the outside. When a predetermined acid value is reached, the reaction is terminated. The reaction solution is then cooled and a target reaction compound is obtained. Thus, a polyester resin is produced.

The content of a binding resin in a toner according to an exemplary embodiment is not particularly restricted; however, the content of a binding resin is preferably 5 to 95 wt %, more preferably 20 to 90 wt %, and still more preferably 40 to 85 wt %, relative to the entire weight of an electrostatic image developing toner. When such a range is satisfied, the toner is excellent in terms of fixability, storability, powder characteristics, charging characteristics, or the like.

Release Agent

A toner according to an exemplary embodiment at least contains a release agent. The release agent contains an organic silicon compound including a siloxane bond and the organic silicon compound is present in a domain of the release agent.

For example, as in a heating member composed of a solid metal or the like, when at least the uppermost surface layer of a heating member has a surface energy of $30\times10^{-3}$ N/m or more or about $30\times10^{-3}$ N/m or more, since an organic silicon compound including a siloxane bond is present in a domain of such a release agent, the contact angle between the release agent being molten and the heating member is 50° or less or about 50° or less. Thus, a release agent used in an exemplary embodiment has a high affinity for a heating member having a high surface energy.

Such a release agent used in an exemplary embodiment is not particularly restricted and an existing release agent may be used. In particular, release agents are preferably obtained from the following waxes: paraffin wax and derivatives thereof, montan waxes and derivatives thereof, microcrystalline waxes and derivatives thereof, Fischer-Tropsch waxes and derivatives thereof, polyolefin waxes and derivatives thereof, and the like. Such derivatives include oxides, polymers of waxes and vinyl monomers, and graft-modified waxes. Other than these examples, an alcohol, a fatty acid, a plant wax, an animal wax, a mineral wax, an ester wax, an acid amide, or the like may be used.

Such a wax used as a release agent is preferably molten at a temperature of 70° C. to 140° C. or about 70° C. to about 140° C. and preferably has a melt viscosity of 1 to 200 centipoises, more preferably, 1 to 100 centipoises. When such a wax is molten at 70° C. or more or about 70° C. or more, the change temperature of the wax is sufficiently high and the wax has excellent resistance to blocking and an excellent developing property at a high temperature within a copier. When such a wax is molten at 140° C. or less or about 140° C. or less, the change temperature of the wax is sufficiently low and fixing at high temperature is not necessary. Thus, such a wax is excellent in terms of energy conservation. When such a wax has a melt viscosity of 200 centipoises or less, the wax is appropriately discharged from a toner and the toner has an excellent fixing peeling property.

The content of the release agent is preferably 3 to 60 wt %, more preferably 5 to 40 wt %, and still more preferably 7 to 20 wt %, relative to the entire weight of the toner. When such a range is satisfied, offset of the toner to a heating member is further suppressed and contamination of a feed roller is further suppressed.

An organic silicon compound present in a domain of a release agent according to an exemplary embodiment is not particularly restricted as long as the organic silicon compound includes a siloxane bond. Specific examples of such an organic silicon compound include polydimethylsiloxane, polymethyl phenyl siloxane, acryl-silicone copolymers, and the like.

Such an organic silicon compound may contain a hydrophilic group such as an amino group, an epoxy group, a hydroxyl group, a carboxyl group, a methacrylic group, or a sulfo group. Of these, the organic silicon compound preferably contains an amino group. When the organic silicon compound contains such a hydrophilic group, the release agent has a higher affinity for a heating member.

Such an organic silicon compound may have a molecular weight of 100 to 5,000, or about 100 to about 5,000.

It will suffice that such an organic silicon compound is molten at the temperature of a heating member in the fixing of images, that is, a fixing temperature. Thus, the organic silicon compound may be in the form of oil, wax, or the like at room temperature.

The content of such an organic silicon compound is preferably 0.1 to 3.0 wt % or about 0.1 to about 3.0 wt %, more preferably 0.5 to 2.5 wt %, and still more preferably 1.0 to 2.0 wt %, relative to the entire weight of the toner. When such a range is satisfied, the release agent has a higher affinity for a heating member.

The organic silicon compound is present in a domain of the release agent in the form of a composite of the organic silicon compound and the release agent. Such a composite may be formed by, for example, melting and mixing the release agent and the organic silicon compound under a shear force.

Specifically, the release agent and the organic silicon compound are heated to a temperature higher than the melting point of the release agent by 10° C. or more, and stirred and mixed with a rotary shearing homogenizer or the like. Thus, a mixture of the release agent and the organic silicon compound is provided. When the release agent and the organic silicon compound are molten and mixed under a shear force, the mixing may be performed to an extent such that the release agent and the organic silicon compound do not visually separate from each other after the mixture is left for 5 minutes under heating.

The release agent being molten and containing the organic silicon compound including a siloxane bond in a domain of the release agent has a contact angle of 50° or less or about 50° or less, preferably 20° or less, more preferably 10° or less, with respect to a heating member. When such a range is satisfied, the release agent having been discharged from a toner has a high affinity for a heating member and uniformly spreads over the heating member. In addition, migration of the release agent onto a recording medium such as a paper sheet on which an image has been subsequently formed is reduced.

Coloring Agent

A toner according to an exemplary embodiment may contain a coloring agent.

Representative examples of such a coloring agent include carbon black, nigrosine, aniline blue, calco oil blue, chrome yellow, ultramarine blue, Dupont oil red, quinoline yellow, methylene blue chloride, phthalocyanine blue, malachite green oxalate, lampblack, rose bengal, C.I. Pigment red 48:1, C.I. Pigment red 122, C.I. Pigment red 57:1, C.I. Pigment red 238, C.I. Pigment yellow 97, C.I. Pigment yellow 12, C.I. Pigment yellow 180, C.I. Pigment blue 15:1, and C.I. Pigment blue 15:3.

Such a coloring agent may be used alone or in combination of two or more thereof.

In a toner according to an exemplary embodiment, a coloring agent is selected in view of hue angle, chroma, value, weather resistance, OHP transparency, and dispersibility in the toner. The amount of a coloring agent added is not particularly restricted; however, the amount is preferably in the range of 3 to 60 wt % relative to the entire weight of the toner.

Other Additives

In addition to the above-described components, if necessary, a toner according to an exemplary embodiment may further contain various components such as an internal additive, a charge control agent, an inorganic powder (inorganic particles), and organic particles.

Examples of the internal additive include metals such as ferrite, magnetite, reduced iron, cobalt, nickel, and manganese; alloys of such metals; and magnetic substances such as compounds containing such metals.

Examples of the charge control agent include dyes composed of quaternary ammonium salt compounds, nigrosine compounds, and complexes of aluminum, iron, and chromium; and triphenylmethane pigments.

The inorganic powder is added to toner base particles for the purpose of principally adjusting the viscoelasticity of the toner. Examples of the inorganic powder include all the inorganic particles that are generally used as external additives for the surfaces of toner particles and will be listed below in detail such as particles of silica, alumina, titania, calcium carbonate, magnesium carbonate, calcium phosphate, and ceric oxide.

A toner according to an exemplary embodiment preferably has a volume average particle size of 2 to 9 μm, more preferably 3 to 7 μm. When such a range is satisfied, the toner is excellent in terms of charging property, developing property, and resolution of images.

A toner according to an exemplary embodiment preferably has a volume average particle size distribution index GSDv of 1.30 or less. When the volume distribution index GSDv is 1.30 or less, the toner is excellent in terms of resolution of images.

In an exemplary embodiment, the particle size and the volume average particle size distribution index GSDv of a toner are measured and calculated in the following manner. The particle size distribution of a toner is measured with a measurement apparatus such as a COULTER COUNTER TAII (manufactured by Beckman Coulter, Inc.) or a Multisizer II (manufactured by Beckman Coulter, Inc.). In a divided particle size range (channel) of the particle size distribution, a cumulative distribution curve is drawn from the small particle size side of the channel with respect to the volume of individual toner particles. The particle size at which a cumulative percentage of 16% of the total toner particles is attained is defined as a volume average particle size $D_{16v}$. The particle size at which a cumulative percentage of 50% of the total toner particles is attained is defined as a volume average particle size $D_{50v}$. Similarly, the particle size at which a cumulative percentage of 84% of the total toner particles are attained is defined as a volume average particle size $D_{84v}$. The volume average particle size distribution index (GSDv) is calculated with a defined relational expression of $GSDv=D_{84v}/D_{16v}$.

As for a toner according to an exemplary embodiment, a shape factor SF1 (=((absolute maximum length of toner particles)$^2$/project area of toner particles)×(π/4)×100) is preferably in the range of 110 to 160, more preferably, in the range of 125 to 140.

The shape factor SF1 indicates the circularity of toner particles. When toner particles are spherical, the shape factor SF1 thereof is 100. As toner particles deviate from the spherical shape, the shape factor SF1 thereof increases. The values necessary for calculating the shape factor SF1, that is, the absolute maximum length of toner particles and the project area of the toner particles are measured in the following manner. A picture (magnified 500×) of toner particles is taken with an optical microscope (Microphoto-FXA manufactured by Nikon Corporation). The resultant image information is introduced into, for example, an image analysis apparatus (Luzex III manufactured by NIRECO CORPORATION) through an interface and subjected to an image analysis. Thus, the values are measured. The average of the shape factor SF1 is calculated from data obtained by measuring 1,000 toner particles that are randomly sampled.

When the shape factor SF1 is 110 or more, generation of remaining toner in the transfer of an image upon image formation is suppressed and such a toner exhibits an excellent cleaning property when being cleaned with a blade or the like. As a result, the occurrence of image defect is suppressed. When the shape factor SF1 is 160 or less, in the case of using such a toner as a developer, destruction of the toner caused by the impact between the toner and carriers in a developing device is suppressed. As a result, generation of micropowder is suppressed. Thus, contamination of the surface of a photoconductor member or the like by a release agent component exposed on the surface of the toner is suppressed. In addition, the toner has excellent charging characteristics and, for example, the occurrence of fogging caused by micropowder is suppressed.

Method for Producing Electrostatic Image Developing Toner

A method for producing a toner according to an exemplary embodiment includes melting and mixing a release agent and an organic silicon compound including a siloxane bond under a shear force; preparing agglomeration particles by agglomerating particles of a binding resin in a dispersion solution containing a resin particle dispersion solution in which the particles of the binding resin are dispersed and a release agent dispersion solution in which the release agent and the organic silicon compound that have been molten and mixed together; and fusing the agglomeration particles by heating.

As described above, a release agent and an organic silicon compound including a siloxane bond are molten and mixed together under a shear force for the purpose of making the organic silicon compound including a siloxane bond be present in a domain of the release agent in the form of a composite of the organic silicon compound and the release agent.

As for a method for producing core particles of a toner, there is a method for producing a toner by forming polymerizable monomer particles and/or polymer particles in an aqueous medium, such as a suspension polymerization method, an emulsion agglomeration method, a seed polymerization method, or a swelling polymerization method. Since a toner having a core-shell structure is readily produced, a wet production method, in particular, an emulsion agglomeration method is preferably employed.

An emulsion agglomeration method is performed as follows. A resin particle dispersion substance prepared by emulsion polymerization or emulsification is mixed with, in an aqueous medium, an additive dispersion substance for imparting a necessary function as a toner, such as an aqueous dispersion substance of a coloring agent, a charge control agent, a release agent, or the like. In the aqueous medium, agglomeration growth of particles is performed with an agglomeration agent or the like under mechanical shearing with various dispersion apparatuses such as a homomixer. Furthermore, the resin particles are fused to form toner particles (core particles).

An emulsion agglomeration method may include an agglomeration step in which a mixed dispersion solution prepared by mixing at least a first resin particle dispersion solution in which first resin particles composed of a first binding resin and having a volume average particle size of 1 μm or less are dispersed and a coloring agent particle dispersion solution in which a coloring agent is dispersed, is mixed with an agglomeration agent and heated to form core particles; an adhesion step in which the mixed dispersion solution containing the core particles is mixed with a second resin particle dispersion solution in which second resin particles composed of a second binding resin and having a volume average particle size of 1 μm or less are dispersed to make the second resin particles adhere to the surfaces of the core particles to form resin-adhered agglomeration particles; and a fusion step in which the resin-adhered agglomeration particles are fused.

In the agglomeration step, core particles (core agglomeration particles) in which particle components in the mixed dispersion solution are just agglomerated may be formed; or core particles (core fusion particles) in which particle components in the mixed dispersion solution are agglomerated and fused at a heating temperature higher than the glass transition temperature of the first binding resin. The fusion step may be performed under heating at a temperature equal to or higher than the glass transition temperature that is the higher of the glass transition temperatures of the first and second binding resins; however, when the resin-adhered agglomeration particles are formed from core fusion particles, the fusion step may be performed with a mechanical stress. The steps will be described in detail.

An emulsion agglomeration method is a method in which a resin dispersion solution is prepared by emulsion polymerization or emulsification, a release agent particle dispersion solution in which a release agent is dispersed is prepared, and preferably a coloring agent particle dispersion solution in which a coloring agent is dispersed in a medium is prepared, and these dispersion solutions are mixed together to form agglomeration particles having a size corresponding to the size of toner particles (agglomeration step); and the agglomeration particles are subsequently fused by heating (fusion step) to form toner particles. An adhesion step in which resin particles are further made to adhere to the agglomeration particles is preferably performed after the agglomeration step and before the fusion step.

Hereinafter, a method for producing a toner, the method being suitable for producing a toner according to an exemplary embodiment, will be described in further detail.

Method for Producing Toner

Hereinafter, a method for producing a toner including the agglomeration step, the adhesion step, and the fusion step according to an exemplary embodiment will be described in further detail in terms of each step.

Agglomeration Step

In the agglomeration step, a mixed dispersion solution prepared by mixing together a first binding resin dispersion solution, a release agent dispersion solution, preferably a coloring agent dispersion solution, and another component is mixed with an agglomeration agent and heated at a temperature slightly lower than the melting point of the first binding resin to form agglomeration particles (core agglomeration particles) in which such component particles have been agglomerated together. Note that, the heating may be performed at a temperature equal to or higher than the glass transition temperature of the first binding resin to cause agglomeration and fusion to form fusion particles (core fusion particles).

The agglomeration particles are formed by adding an agglomeration agent to the mixed dispersion solution at room temperature while the mixed dispersion solution is stirred with a rotary shearing homogenizer. Such an agglomeration agent suitably used in the agglomeration step is a surfactant having a polarity opposite to that of a surfactant used as a dispersion agent for dispersion solutions, an inorganic metal salt, or a metal complex that is divalent or more.

In particular, use of such a metal complex is preferred because the amount of a surfactant used is reduced and charging characteristics of the toner are enhanced.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide. Of these, in particular, aluminum salts and polymers thereof are preferred. To achieve a sharper particle size distribution, as the valence of such an inorganic metal salt, divalence is more suitable than monovalence; trivalence is more suitable than divalence; quadvalence is more suitable than trivalence; and, between inorganic metal salts having the same valence, a polymer of the inorganic metal salt is more suitable.

Adhesion Step

In the adhesion step, resin particles composed of the second binding resin are made to adhere to the surfaces of the core particles (core agglomeration particles or core fusion particles) containing the first binding resin, the core particles having been formed by the above-described agglomeration step, to form coating layers (hereafter, agglomeration particles in which the coating layers are formed on the surfaces of the core particles are also referred to as "resin-adhered agglomeration particles"). Here, the coating layers correspond to shell layers of a toner according to an exemplary embodiment, the toner being formed by the fusion step described below.

The coating layers (shell layers) may be formed by additionally adding a dispersion solution of second resin particles to the dispersion solution in which the core particles have been formed in the agglomeration step. If necessary, another component may also be added at this time.

When the resin-adhered agglomeration particles in which resin particles are made to uniformly adhere to the surfaces of the core particles to form coating layers are heated and fused in the fusion step described below, the resin particles composed of the second binding resin and contained in the coating layers on the surfaces of the core particles are molten to form shell layers. As a result, components such as a release agent contained within the core particles positioned inside the shell layers are effectively prevented from being exposed on the surfaces of the toner particles.

In the adhesion step, a technique of adding and mixing the dispersion solution of the second resin particles with the core particles is not particularly restricted. For example, the adding and mixing of the dispersion solution may be gradually continuously performed or may be divided into plural times and performed in a stepwise manner. Thus, by performing the adding and mixing of the dispersion solution of the second resin particles, the generation of micro-particles is suppressed and the resultant toner has a sharp particle size distribution.

In an exemplary embodiment, the number of times the adhesion step is performed may be one or plural. When the adhesion step is performed only once, a single layer principally composed of the second binding resin is formed on the surfaces of the core agglomeration particles. In contrast, when the adhesion step is performed plural times, by using plural dispersion solutions including the dispersion solution of the second resin particles, a peeling agent dispersion solution, and a particle dispersion solution of another component, layers principally composed of such specified components are stacked on the surfaces of the core agglomeration particles.

When the adhesion step is performed plural times, toner particles having a complex and precise multilayer structure are obtained and the toner may be made to have an intended function. When the adhesion step is performed plural times or in a stepwise manner, the composition or physical properties of the resultant toner particles from the surface to the inside of the toner particles may be made to change in a stepwise manner and the structure of the toner particles is readily controlled. In such a case, plural layers are stacked in a stepwise manner on the surfaces of the core particles and, from the inner portion to the outer portion of the toner particles, a structure change or a composition gradient is provided and physical properties are made to change. In addition, in such a case, the shell layer corresponds to all the layers stacked on the surface of the core particle. The outermost layer is constituted by a layer principally composed of the second binding resin. In the following description, a case where the adhesion step is performed only once will be described.

Conditions under which resin particles composed of the second binding resin are made to adhere to the core particles are as follows. The heating temperature in the adhesion step is preferably approximately the melting point of the first binding resin contained in core agglomeration particles. Specifically, the heating temperature is preferably within the range of ±10° C. relative to the melting point.

When the heating temperature is equal to or higher than the temperature of "the melting point of the first binding resin−10° C.", adhesion between the resin particles composed of the first binding resin in the surfaces of the core particles and the resin particles composed of the second binding resin adhering to the surfaces of the core agglomeration particles is good. As a result, the thickness of the shell layers formed becomes uniform.

When the heating temperature is equal to or less than the temperature of "the melting point of the first binding resin+10° C.", adhesion between the resin particles composed of the first binding resin in the surfaces of the core particles and the resin particles composed of the second binding resin adhering to the surfaces of the core particles is suppressed. Thus, the resultant toner core particles have an excellent particle diameter/particle size distribution.

Since the heating time in the adhesion step depends on the heating temperature, the heating time is not generally determined. However, the heating time may be 5 minutes to 2 hours.

In the adhesion step, the dispersion solution provided by additionally adding the dispersion solution of the second resin particles to the mixed dispersion solution in which core particles have been formed may be left to stand or gently stirred with a mixer or the like. When the dispersion solution is gently stirred with a mixer or the like, uniform resin-adhered agglomeration particles tends to be formed.

Fusion Step

In the fusion step, the resin-adhered agglomeration particles obtained in the adhesion step are fused by heating. The fusion step may be performed at a temperature equal to or higher than the glass transition temperature that is the higher of the glass transition temperatures of the first and second binding resins. As for the time for which the fusion is to be performed, when the heating temperature is high, a short fusion time will suffice; when the heating temperature is low, a long fusion time is required. Specifically, since the fusion time depends on the heating temperature, the fusion time is not generally determined; however, the fusion time may be 30 minutes to 10 hours.

When the core particles are core fusion particles, the resin particles composed of the second binding resin may be made to adhere to the core fusion particles. In such a case, a dispersion solution containing the core fusion particles is once filtrated and the water content of the dispersion solution is controlled to be 30 to 50 wt %. Then, the dispersion solution of the second resin particles is added to the dispersion solution. Thus, the particles composed of the second binding resin are made to adhere to the surfaces of the core fusion particles.

When the water content of the dispersion solution is 30 wt % or more, the adhesion of the particles composed of the second binding resin is good. Accordingly, separation of the particles from the core fusion particles is suppressed. When the water content of the dispersion solution is 50 wt % or less, stirring is readily performed and the particles composed of the second binding resin are made to uniformly adhere to the surfaces of the core fusion particles.

After a washing and drying step described below is complete, by applying a mechanical stress with a Henschel mixer or the like to resin-adhered agglomeration particles obtained by making the particles composed of the second binding resin adhere to the surfaces of the core fusion particles, the particles composed of the second binding resin and adhering to the surfaces of the core fusion particles are fused together. In this way, the fusion step may be performed by, instead of heating in a liquid phase, the application of a mechanical stress.

Washing and Drying Step

The fusion particles obtained by the fusion step may be subjected to solid-liquid separation such as filtration, washing, and drying. As a result, a toner to which an external additive is not added is provided.

The solid-liquid separation is not particularly restricted; however, the solid-liquid separation may be suction filtration, pressure filtration, or the like in view of productivity. The washing may be displacement washing sufficiently performed with ion-exchanged water in view of a charging property. As for the drying step, a standard technique such as a vibration fluidized drying technique, a spray drying technique, a freeze drying technique, a flash jet technique, or the like may be appropriately employed. As for the toner particles, a fraction of water contained after drying is preferably adjusted to be 1.0 wt % or less, more preferably 0.5 wt % or less.

Preparation of Dispersion Solution

To prepare the dispersion solution of the binding resin, an existing emulsification technique is used. In particular, a phase inversion emulsification technique with which the resultant particle size distribution is sharp and the volume average particle size in the range of 0.08 to 0.40 nm is readily achieved is effectively employed.

In the phase inversion emulsification technique, a resin is dissolved in an organic solvent capable of dissolving the resin and a solvent composed of an amphipatic organic solvent or a solvent mixture containing an amphipatic organic solvent to be turned into an oil phase. A small amount of a basic compound is dropped into the oil phase while the oil phase is being stirred. Water is further dropped slowly into the oil phase while the oil phase is being stirred and water droplets are taken into the oil phase. When the amount of water having been dropped exceeds a certain amount, the oil phase and the aqueous phase are exchanged with each other and the oil phase is turned into oil droplets. After that, a step of removing the solvent under a reduced pressure is performed and, as a result, an aqueous dispersion solution is provided.

Here, the amphipatic organic solvent is a solvent having a water solubility of, at 20° C., preferably 5 g/L or more, more preferably 10 g/L or more. When this solubility is 5 g/L or more, the solvent is excellent in terms of the effect of accelerating the processing rate of rendering a dispersion aqueous and the resultant aqueous dispersion substance has excellent storage stability.

Examples of such an organic solvent include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, and cyclohexanol; ketones such as methyl ethyl ketone, methyl isobutyl ketone, ethyl butyl ketone, cyclohexanone, and isophorone; ethers such as tetrahydrofuran and dioxane; esters such as ethyl acetate, n-propyl acetate, isopropyl acetate, n-butyl acetate, isobutyl acetate, sec-butyl acetate, 3-methoxybutyl acetate, methyl propionate, ethyl propionate, diethyl carbonate, and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, and dipropylene glycol monobutyl ether; 3-methoxy-3-methylbutanol, 3-methoxybutanol, acetonitrile, dimethylformamide, dimethylacetamide, diacetone alcohol, and ethyl acetoacetate.

These solvents may be used alone or in combination of two or more thereof.

As for the basic compound, in an exemplary embodiment, a polyester resin used as a binding resin may be neutralized with a basic compound when being dispersed in an aqueous medium. In an exemplary embodiment, the neutralization reaction between such a basic compound and carboxyl groups of a polyester resin is a motive force for rendering a dispersion aqueous. In addition, agglomeration of particles is suppressed due to the electric repulsive force between carboxyl anions generated.

Examples of the basic compound include ammonia and organic amine compounds having a boiling point of 250° C. or less.

Preferred examples of the organic amine compounds include triethylamine, N,N-diethylethanolamine, N,N-dimethylethanolamine, aminoethanolamine, N-methyl-N,N-diethanolamine, isopropylamine, iminobispropylamine, ethylamine, diethylamine, 3-ethoxypropylamine, 3-diethylaminopropylamine, sec-butylamine, propylamine, methylaminopropylamine, dimethylaminopropylamine, methyliminobispropylamine, 3-methoxypropylamine, monoethanolamine, diethanolamine, triethanolamine, morpholine, N-methylmorpholine, and N-ethylmorpholine.

The basic compound may be added in an amount in accordance with the amount of carboxyl groups contained in a polyester resin so as to at least partially neutralize the carboxyl groups. Specifically, the amount of the basic compound added is preferably 0.2 to 9.0 times the equivalent amount of the carboxyl groups, more preferably 0.6 to 2.0 times. When the amount of the basic compound added is 0.2 times or more the equivalent amount, the effect of adding the basic compound is sufficiently provided. When the amount of the basic compound added is 9.0 times or less the equivalent amount, a good dispersion solution in which the oil phase has an appropriate hydrophilicity and the particle size distribution is narrow is provided.

The release agent dispersion solution is prepared by at least dispersing a release agent. As described above, the release agent dispersed is a release agent in which an organic silicon compound including a siloxane bond has been made present in the form of a composite of the organic silicon compound and the release agent in the melting and mixing of the organic silicon compound and the release agent.

The release agent may be dispersed by an existing technique. For example, a rotary shearing homogenizer, a media-type dispersion apparatus such as a ball mill, a sand mill, or an attritor, a high-pressure counter-impact dispersion apparatus, or the like is preferably used. Alternatively, the release agent particle dispersion solution may be prepared by using an ionic surfactant having a polarity as the release agent and dispersing the release agent in an aqueous medium by using a homogenizer as described above. In an exemplary embodiment, the release agent may be a single release agent or a combination of two or more release agents. The release agent particles preferably have an average particle size of 1.0 μm or less, more preferably 0.1 to 0.5 μm.

The coloring agent dispersion solution is prepared by at least dispersing a coloring agent.

The coloring agent may be dispersed by an existing technique. For example, a rotary shearing homogenizer, a media-type dispersion apparatus such as a ball mill, a sand mill, or an attritor, a high-pressure counter-impact dispersion apparatus, or the like is preferably used. Alternatively, the coloring agent particle dispersion solution may be prepared by using an ionic surfactant having a polarity as the coloring agent and dispersing the coloring agent in an aqueous medium by using a homogenizer as described above. The coloring agent may be a single coloring agent or a combination of two or more coloring agents. The coloring agent preferably has a volume average particle size (hereafter, also simply referred to as "average particle size") of 1 μm or less, more preferably 0.5 μm or less, in particular, preferably 0.01 to 0.5 μm.

The combination of the resin of the resin particles, the release agent, and the coloring agent is not particularly restricted and may be freely selected in accordance with a purpose.

In an exemplary embodiment, another component (particles) such as an internal additive, a charge control agent, an inorganic particle material, an organic particle material, a lubricant, or a polishing agent may be dispersed in at least any one of the binding resin dispersion solution, the release agent dispersion solution, and the coloring agent dispersion solution in accordance with a purpose. In such a case, another component (particles) may be dispersed in at least any one of the binding resin dispersion solution, the release agent dispersion solution, and the coloring agent dispersion solution; or a dispersion solution in which another component (particles) has been dispersed may be mixed with a mixture prepared by mixing together the resin particle dispersion solution, the release agent dispersion solution, and the coloring agent dispersion solution.

Examples of a dispersion medium for the binding resin dispersion solution, the release agent dispersion solution, the coloring agent dispersion solution, and the another component include aqueous media.

Examples of such aqueous media include water such as distilled water and ion-exchanged water and alcohols. These aqueous media may be used alone or in combination of two or more thereof. A preferred combination is a combination of distilled water and ion-exchanged water. Addition of a surfactant is effective in view of the stability of dispersion particles such as resin particles, coloring agent particles, and release agent particles in an aqueous medium, the storability of a dispersion solution, and, in addition, the stability of the agglomeration particles in the agglomeration step.

Examples of a dispersion agent added for enhancing the dispersion stability of a coloring agent in an aqueous medium and decreasing the energy of the coloring agent in a toner include rosin, rosin derivatives, coupling agents, and polymeric dispersion agents.

In an exemplary embodiment, to enhance the dispersion stability, a surfactant may be added to and mixed with an aqueous medium.

The volume average primary particle size of the thus-prepared particle dispersion solution may be measured with, for example, a laser diffraction particle size distribution measurement apparatus (LA-700 manufactured by HORIBA, Ltd.). The measurement method is as follows. A sample in the form of a dispersion solution is adjusted so as to be about 2 g in terms of solid content and mixed with ion-exchanged water to prepare a solution of about 40 ml. This solution is charged into a cell until an appropriate concentration is achieved. Then, after the solution in the cell has been left for about 2 minutes and the concentration of the solution in the cell has stabilized, the measurement is performed. The thus-measured volume average primary particle sizes of channels are cumulated from small volume average primary particle sizes. The particle size at which a cumulative percentage of 50% of the total particles is attained is defined as a volume average primary particle size.

External Addition Step

A technique of externally adding inorganic particles of silica, titania, or the like to the surfaces of toner base particles is not particularly restricted and an existing technique may be employed. For example, such inorganic particles may be made to adhere by a mechanical technique or a chemical technique.

Electrostatic Image Developer

An electrostatic image developing toner according to an exemplary embodiment may be used as an electrostatic image developer.

An electrostatic image developer according to an exemplary embodiment is not particularly restricted except that the electrostatic image developer contains an electrostatic image developing toner according to an exemplary embodiment. Thus, an electrostatic image developer according to an exemplary embodiment may have an appropriate component composition in accordance with a purpose. When only an electrostatic image developing toner according to an exemplary embodiment is used, a one-component system electrostatic image developer is prepared. When an electrostatic image developing toner according to an exemplary embodiment is used together with carriers, a two-component system electrostatic image developer is prepared.

A technique may be employed in which triboelectrification is caused between a one-component system developer and a developing sleeve or a charging member to form a charged toner and an electrostatic latent image is developed with the charged toner.

In an exemplary embodiment, a development system is not particularly restricted; however, a two-component development system may be used. As long as the above-described conditions are satisfied, carriers are not particularly restricted. An example of a core material of such carriers is a magnetic metal such as iron, steel, nickel, or cobalt; an alloy between such a magnetic metal and manganese, chromium, and a rare-earth metal; a magnetic oxide such as ferrite or magnetite; or the like. Of these, in view of surface properties of a core material and the resistance of a core material, ferrite, in particular, an alloy between ferrite and manganese, lithium, strontium, magnesium, or the like is preferably used.

Carriers used in an exemplary embodiment may be prepared by coating the surfaces of core materials with a resin. Such a resin is not particularly restricted and may be appropriately selected in accordance with a purpose. Such a resin may be an existing resin and examples thereof include polyolefin resins such as polyethylene and polypropylene; polyvinyl resins and polyvinylidene resins such as polystyrene, acrylic resins, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; styrene-acrylic resin copolymers; straight silicone resins including organosiloxane bonds and modifications of such straight silicone resins; fluorocarbon resins such as polytetrafluoroethylene, polyvinyl fluoride, polyvinylidene fluoride, and polychlorotrifluoroethylene; silicone resins; polyesters; polyurethanes; polycarbonate; phenolic resins; amino resins such as urea-formaldehyde resins, melamine resins, benzoguanamine resins, urea resins, and polyamide resins; and epoxy resins. These resins may be used alone or in combination of two or more thereof. In an exemplary embodiment, of these resins, use of at least a fluorocarbon resin and/or a silicone resin is preferred. When at least a fluorocarbon resin and/or a silicone resin is used as the resin, the effect of suppressing carrier contamination (impaction) caused by a toner or an external additive is sufficiently provided.

As for such a coating film of a resin, resin particles and/or conductive particles may be dispersed in the resin. Examples of such resin particles include thermoplastic resin particles and thermosetting resin particles. Of these, thermosetting resin particles are preferred in view of relatively readily increasing the hardness of the coating, and resin particles of nitrogen containing resins containing nitrogen atoms are preferred in view of making the toner negatively charged. Such resin particles may be constituted by a single resin or two or more resins. The resin particles preferably have an average particle size of 0.1 to 2 μm, more preferably 0.2 to 1 μm. When the resin particles have an average particle size of 0.1 μm or more, the dispersibility of the resin particles in the coating film is excellent. When the resin particles have an average particle size of 2 μm or less, the resin particles are less likely to separate from the coating film.

Examples of the conductive particles include particles of metals such as gold, silver, and copper; carbon black particles; and particles prepared by coating the surfaces of powder particles of titanium oxide, zinc oxide, barium sulfate, aluminum borate, potassium titanate, and the like with tin oxide, carbon black, metals, and the like. Such conductive particles may be constituted by a single type or two or more types. Of these conductive particles, carbon black particles are preferred because carbon black particles are good in terms of production stability, cost, conductivity, and the like. Types of the carbon black are not particularly restricted; however, a carbon black having a dibutyl phthalate (DBP) oil absorption of 50 to 250 ml/100 g is preferred because such a carbon black is excellent in terms of production stability. The coating amount of the resin, the resin particles, and the conductive particles on the surfaces of core materials is preferably 0.5 to 5.0 wt %, more preferably 0.7 to 3.0 wt %.

A technique of forming the coating film is not particularly restricted; however, for example, a technique may be employed in which a solution for forming the coating film is used, the solution containing, in a solvent, the resin particles such as crosslinkable resin particles and/or the conductive particles and the resin serving as a matrix resin such as a styrene-acrylic resin, a fluorocarbon resin, or a silicone resin.

Specifically, for example, there are an immersion technique in which the carrier core materials are immersed in a solution for forming the coating film, a spraying technique in which a solution for forming the coating film is sprayed onto the surfaces of the carrier core materials, and a kneader coater technique in which the carrier core materials being suspended by an air flow are mixed with a solution for forming the coating film and the solvent of the solution is removed. Of these, in an exemplary embodiment, the kneader coater technique is preferred.

The solvent used for the solution for forming the coating film is not particularly restricted as long as the solvent is capable of dissolving only the resin serving as a matrix resin. Such a solvent may be selected from existing solvents and examples thereof include aromatic hydrocarbons such as toluene and xylene, ketones such as acetone and methyl ethyl ketone, and ethers such as tetrahydrofuran and dioxane. When the resin particles are dispersed in the coating film, since the resin particles and the particles serving as a matrix resin are uniformly dispersed in the thickness direction of the coating film and the tangential direction of the carrier surface, even when the carriers are used for a long period of time and the coating films are worn down, the surface configuration similar to that in unused carriers is always maintained and a good capability of charging the toner is maintained for a long period of time. When the conductive particles are dispersed in the coating film, since the conductive particles and the particles serving as a matrix resin are uniformly dispersed in the thickness direction of the coating film and the tangential direction of the carrier surface, even when the carriers are used for a long period of time and the coating films are worn down, the surface configuration similar to that in unused carriers is always maintained and degradation of the carriers is suppressed for a long period of time. When the resin particles and the conductive particles are dispersed in the coating film, the above-described advantages are simultaneously achieved.

The thus-formed magnetic carriers as a whole in the form of a magnetic brush in an electric field of $10^4$ V/cm may have an electrical resistance of $10^8$ to $10^{13}$ Ωcm. When the magnetic carriers have an electrical resistance of $10^8$ Ωcm or more, adhesion of the carriers to an image portion on an image carrier is suppressed and brush marks are less likely to be formed. When the magnetic carriers have an electrical resistance of $10^{13}$ Ωcm or less, the occurrence of the edge effect is suppressed and high image quality is achieved.

The volume resistivity is measured in the following manner.

A measurement jig constituted by a pair of circular plates (made of steel) having an area of 20 $cm^2$ is connected to an electrometer (product name: KEITHLEY 610C, manufactured by Keithley Instruments, Inc.) and a high voltage power supply (product name: FLUKE 415B, manufactured by Fluke Corporation). A sample is placed on the lower plate of the measurement jig so as to form a flat layer having a thickness of about 1 to 3 mm. Then, the upper plate is placed on the sample. To remove gaps between the sample and the plates, a weight of 4 kg is placed on the upper plate. In such a state, the thickness of the sample layer is measured. Then, a voltage is applied between the two plates and the current value is measured. The volume resistivity is then calculated with the following formula.

Volume resistivity=applied voltage×20/(current value−initial current value)/sample thickness In this formula, the "initial current value" is the current value when the applied voltage is zero. The "current value" is the current value measured in the above-described manner.

As for the mixing proportion of a toner according to an exemplary embodiment relative to carriers in a two-component system electrostatic image developer, the toner may be 2 to 10 parts by weight relative to 100 parts by weight of the carriers. A technique used for preparing the developer is not particularly restricted; however, for example, a technique of performing mixing with a V-blender or the like may be employed.

Image Forming Method

An electrostatic image developer (electrostatic image developing toner) is used for a method for forming an image employing an electrostatic image developing system (electrophotographic system).

A method for forming an image according to an exemplary embodiment includes charging an image holding body; forming an electrostatic latent image on a surface of the image holding body; developing the electrostatic latent image formed on the surface of the image holding body by using an electrostatic image developing toner or an electrostatic image developer containing an electrostatic image developing toner to form a toner image; transferring the toner image formed on the surface of the image holding body onto a surface of a transfer body; and fixing the toner image that is unfixed and formed on the transfer body by passing the transfer body between a heating member and a pressing member, wherein at least an uppermost surface layer of the heating member has a surface energy of $30\times10^{-3}$ N/m or more and $3{,}000\times10^{-3}$ N/m or less, or about $30\times10^{-3}$ N/m or more and about $3{,}000\times10^{-3}$ N/m or less, and the electrostatic image developing toner contains a release agent in which a contact angle between the release agent being molten and the heating member is 50° or less or about 50° or less.

In a method for forming an image according to an exemplary embodiment, a heating member used is a heating member that is not covered by a release layer composed of a material having a low surface energy such as a fluorocarbon resin and that has a high surface energy. Specifically, at least an uppermost surface layer of the heating member has a surface energy of $30\times10^{-3}$ N/m or more and $3{,}000\times10^{-3}$ N/m or less, or about $30\times10^{-3}$ N/m or more and about $3{,}000\times10^{-3}$ N/m or less.

Except for the use of a heating member having a high surface energy and the use of an electrostatic image developing toner according to an exemplary embodiment, the above-described steps are standard steps and described in, for example, Japanese Unexamined Patent Application Publication Nos. 56-40868, 49-91231, and the like. A method for forming an image according to an exemplary embodiment may be performed with an image forming apparatus such as an existing copier or an existing facsimile machine.

As described above, an image holding body is charged.

An electrostatic latent image is formed on a surface of the image holding body.

The electrostatic latent image formed on the surface of the image holding body is developed by using an electrostatic image developing toner according to an exemplary embodiment or an electrostatic image developer containing an electrostatic image developing toner according to an exemplary embodiment to form a toner image.

The toner image is transferred onto a surface of a transfer body.

The toner image that is unfixed and formed on the transfer body is fixed by passing the transfer body between a heating member and a pressing member.

As for the heating member used in the fixing of the toner image, at least an uppermost surface layer of the heating member has a surface energy of $30\times10^{-3}$ N/m or more and $3{,}000\times10^{-3}$ N/m or less, or about $30\times10^{-3}$ N/m or more and about $3{,}000\times10^{-3}$ N/m or less, preferably $300\times10^{-3}$ N/m or more and $1{,}500\times10^{-3}$ N/m or less.

A heating member having such a high surface energy is preferably formed of a metal material or an inorganic material, more preferably a metal material.

Examples of such a metal material for forming the heating member include metals such as Fe, Cr, Cu, Ni, Co, Mn, Al, and stainless steel; alloys of such metals; and oxides of such metals. Of these, Al and stainless steel are preferred and Al is more preferred.

Examples of such an inorganic material for forming the heating member include glasses and ceramics.

The heating member may be formed such that at least the uppermost surface layer is formed of such a metal material or an inorganic material. For example, the entirety of the heating member may be formed of such a metal material or an inorganic material; or, alternatively, the uppermost surface layer of the heating member may be formed of such a metal material or an inorganic material and portions other than the uppermost surface layer may be formed of another material.

The heating member may have the shape of, for example, a tubular roller.

In the fixing of a toner image, the heating member is heated at a temperature equal to or higher than the melting point of a release agent and the release agent contained in a toner is molten by the heating member. In the fixing of a toner image, the heating member is preferably made to have a temperature of 130° C. to 170° C. or about 130° C. to about 170° C., more preferably 140° C. to 160° C. When such a range is satisfied, a release agent contained in a toner is molten with certainty.

As described above, a release agent used in an exemplary embodiment contains an organic silicon compound including a siloxane bond and the contact angle between the release agent being molten and a heating member is 50° or less, or about 50° or less. Accordingly, the release agent having been discharged from the toner uniformly spreads over the heating member due to high affinity. In addition, migration of the release agent onto a recording medium such as a paper sheet on which an image has been subsequently formed is reduced. Thus, contamination of a feed roller that transports a recording medium on which an image has been formed due to a release agent is suppressed and malfunction during continuous operation is suppressed.

Image Forming Apparatus

An image forming apparatus according to an exemplary embodiment includes an image holding body; a charging section that charges the image holding body; a latent image forming section that forms an electrostatic latent image on a surface of the image holding body; a developing section that develops the electrostatic latent image formed on the surface of the image holding body, by using an electrostatic image developing toner or an electrostatic image developer containing an electrostatic image developing toner to form a toner image; a transfer section that transfers the toner image formed on the surface of the image holding body onto a surface of a transfer body; and a fixing section that fixes the toner image that is unfixed and formed on the transfer body by passing the transfer body between a heating member and a pressing member, wherein at least an uppermost surface layer of the heating member has a surface energy of $30\times10^{-3}$ N/m or more and $3{,}000\times10^{-3}$ N/m or less or about $30\times10^{-3}$ N/m or more and about $3{,}000\times10^{-3}$ N/m or less and the electrostatic image developing toner contains a release agent in which a contact angle between the release agent being molten and the heating member is 50° or less or about 50° or less.

As for the image holding body and the above-described sections, the configurations described in "Image forming method" may be employed.

As the above-described sections, existing sections in an image forming apparatus may be employed. An image forming apparatus according to an exemplary embodiment may include another section, device, or the like other than those in the above-described configuration. In an image forming apparatus according to an exemplary embodiment, plural sections among the above-described sections may be simultaneously operated.

The fixing section according to an exemplary embodiment may be an existing fixing device. As the heating member, as described above, a heating member in which at least an uppermost surface layer has a surface energy of $30\times10^{-3}$ N/m or more and $3{,}000\times10^{-3}$ N/m or less, or about $30\times10^{-3}$ N/m or more and about $3{,}000\times10^{-3}$ N/m or less, is used.

Toner Cartridge and Process Cartridge

A toner cartridge according to an exemplary embodiment is a toner cartridge at least containing an electrostatic image developing toner according to an exemplary embodiment. A toner cartridge according to an exemplary embodiment may contain, as an electrostatic image developing toner, an electrostatic image developing toner according to an exemplary embodiment.

A process cartridge according to an exemplary embodiment is a process cartridge including a developing section that develops an electrostatic latent image formed on a surface of an image holding body by using the electrostatic image developing toner or the electrostatic image developer to form a toner image and at least one selected from the group of an image holding body; a charging section that charges the surface of the image holding body; and a cleaning section that removes toner remaining on the surface of the image holding body, the process cartridge at least containing an electrostatic image developing toner according to an exemplary embodiment or an electrostatic image developer according to an exemplary embodiment.

A toner cartridge according to an exemplary embodiment may be detachably mountable to an image forming apparatus. That is, in an image forming apparatus having a configuration in which a toner cartridge is detachably mounted, a toner cartridge according to an exemplary embodiment containing a toner according to an exemplary embodiment is suitably used.

Such a toner cartridge may be a cartridge containing a toner and carriers. Alternatively, a cartridge containing a toner only and a cartridge containing carriers only may be separately provided.

A process cartridge according to an exemplary embodiment may be detachably mounted to an image forming apparatus.

If necessary, a process cartridge according to an exemplary embodiment may further include another member such as a static eliminating section.

As for such a toner cartridge and such a process cartridge, existing configurations may be employed. For example, such configurations are described in Japanese Unexamined Patent Application Publication Nos. 2008-209489, 2008-233736, and the like.

Example of Image Forming Apparatus

An example of an image forming apparatus according to an exemplary embodiment will be described with reference to FIGURE. However, an exemplary embodiment is not restricted to this example. FIGURE is a schematic sectional view illustrating an example of an image forming apparatus according to an exemplary embodiment.

Referring to FIGURE, an automatic document transport device U2 is positioned on the top surface of a platen glass PG at the top end of an image forming apparatus U1 including a copier. The automatic document transport device U2 includes a document feed tray TG1 in which plural documents Gi to be copied are stacked on one another. The plural documents Gi placed in the document feed tray TG1 are sequentially passed through a copying position on the platen glass PG and output into a document output tray TG2. The automatic document transport device U2 is configured to be rotatable away from the image forming apparatus U1 about a hinge shaft (not shown) that is provided in a rear end portion (—X end portion) of the automatic document transport device U2 and extends in the left-right direction. A user rotates the automatic document transport device U2 upward and then manually places the document Gi on the platen glass PG.

The image forming apparatus U1 includes a user interface (UI) through which a user inputs operation command signals, such as the initiation of copying, to operate the image forming apparatus U1. A document reading device IIT is disposed under the platen glass PG, which is transparent, at the top surface of the image forming apparatus U1. The document reading device IIT includes an exposure registration sensor (platen registration sensor) Sp and an exposure optical system A that are positioned at a platen registration position (OPT position). The exposure optical system A is controlled in terms of moving and stopping thereof in accordance with detection signals of the exposure registration sensor Sp. The exposure optical system A is usually stopped at a home position. Reflected light from the document Gi that is being passed through an exposure position on the top surface of the platen glass PG by the automatic document transport device U2 or a document manually placed on the platen glass PG is converted into electrical signals of R (red), G (green), and B (blue) by a solid-state imaging device CCD through the exposure optical system A.

An image processing system IPS converts the RGB electrical signals input from the solid-state imaging device CCD into image data of K (black), Y (yellow), M (magenta), and C (cyan), temporarily stores the image data, and outputs the image data as image data for forming a latent image at a predetermined timing to a laser driving circuit DL. The laser driving circuit DL outputs laser driving signals in accordance with the input image data to a latent image forming device ROS. The operations of the image processing system IPS and the laser driving circuit DL are controlled by a controller C including a microcomputer.

An image carrier PR is being rotated in a direction represented by arrow Ya. The surface of the image carrier PR is uniformly charged by a charging device (charging roller) CR and then subjected to exposure scanning with a laser beam L from the latent image forming device ROS at a latent image writing position Q1. Thus, an electrostatic latent image is formed on the surface of the image carrier PR. When a full color image is formed, electrostatic latent images corresponding to four color images of K (black), Y (yellow), M (magenta), and C (cyan) are sequentially formed. When a monochrome image is formed, only an electrostatic latent image corresponding to a K (black) image is formed.

The surface of the image carrier PR on which the electrostatic latent images are formed is rotated to be sequentially passed through a developing region Q2 and a first transfer region Q3. A rotary system developing device G includes four color developing units GK, GY, GM, and GC respectively corresponding to K (black), Y (yellow), M (magenta), and C (cyan). As the rotary system developing device G is rotated with respect to a rotational shaft Ga, the developing units GK, GY, GM, and GC are sequentially moved to the developing region Q2. The developing units GK, GY, GM, and GC corresponding to the colors each include a developing roller GR that transports a developer to the developing region Q2 and develop the electrostatic latent images, on the image carrier PR, passing through the developing region Q2 into toner images. Toners corresponding to the colors are supplied from toner supply cartridges mounted to cartridge mount sections Hk, Hy, Hm, and He (refer to FIGURE) to developing containers of the developing units GK, GY, GM, and GC. Such a rotary system developing device is described in, for example, Japanese Unexamined Patent Application Publication Nos. 2000-131942, 2000-231250, and the like.

An intermediate transfer belt B, plural belt support rollers (Rd, Rt, Rw, Rf, and T2*a*) including a belt driving roller Rd, a tension roller Rt, a walking roller Rw, an idler roller (free roller) Rf, and a backup roller T2*a*, a first transfer roller T1, and a belt frame (not shown) that supports such components are provided under the image carrier PR. The intermediate transfer belt B is rotatably supported by the belt support rollers (Rd, Rt, Rw, Rf, and T2*a*) and is rotated in a direction represented by arrow Yb when the image forming apparatus is operated.

When a full color image is formed, an electrostatic latent image corresponding to a first color is formed at the latent image writing position Q1 and a toner image Tn corresponding to the first color is formed in the developing region Q2. When the toner image Tn is passed through the first transfer region Q3, the toner image Tn is electrostatically transferred onto the intermediate transfer belt B by the first transfer roller T1. Similarly, toner images Tn corresponding to the second color, the third color, and the fourth color are then sequentially subjected to first transfer onto the intermediate transfer belt B carrying the toner image Tn corresponding to the first color. Finally, a full color multiple toner image is formed on the intermediate transfer belt B. When a monocolor image of a single color is formed, only a single developing unit is used and a single color toner image is subjected to first transfer onto the intermediate transfer belt B. After the first transfer, remaining toner on the surface of the image carrier PR is diselectrified by a static eliminating device JR and cleaned by an image carrier cleaner CL1.

A second transfer roller T2*b* is positioned under the backup roller T2*a* such that the second transfer roller T2*b* is movable between a position separate from the backup roller T2*a* and a position in contact with the backup roller T2*a*. The backup roller T2*a* and the second transfer roller T2*b* constitute a second transfer device T2. A region where the backup roller T2*a* and the second transfer roller T2*b* are in contact with each other forms a second transfer region Q4. A power supply circuit E supplies a second transfer voltage having a polarity opposite to the toner charging polarity used in the developing device G, to the second transfer roller T2*b*. The power supply circuit E is controlled by the controller C.

Recording sheets S contained in a paper feed tray TR1 or TR2 are picked up by a pickup roller Rp at a predetermined timing, separated sheet by sheet by a separation roller R5, and transported to a registration roller Rr through a paper feed path SH1 by plural transport rollers Ra. Each recording sheet S having been transported to the registration roller Rr is transported from a pre-transfer sheet guide SG1 to the second transfer region Q4 at a timing in accordance with the movement of the multiple toner image or the single color toner image having been provided by first transfer to the second transfer region Q4. In the second transfer region Q4, the second transfer device T2 subjects the toner image on the intermediate transfer belt B to electrostatic second transfer onto the recording sheet S. After the second transfer, remaining toner on the intermediate transfer belt B is removed by a belt cleaner CL2. The image carrier PR, the charging roller CR, the developing device G, the first transfer roller T1, the intermediate transfer belt B, the second transfer device T2, and the like constitute a toner image forming device (PR+CR+G+T1+B+T2) that transfers toner images onto the recording sheets S to form the toner images on the recording sheets S.

The second transfer roller T2*b* and the belt cleaner CL2 are provided so as to be freely brought into contact with and separated from the intermediate transfer belt B. When a color image is formed, the second transfer roller T2*b* and the belt cleaner CL2 are separated from the intermediate transfer belt B until an unfixed toner image corresponding to the last color is subjected to first transfer onto the intermediate transfer belt B. A second transfer roller cleaner CL3 is moved so as to be brought into contact with and separated from the intermediate transfer belt B in synchronization with the second transfer roller T2*b*. The recording sheet S onto which the toner image has been subjected to second transfer is transported to a fixing region Q5 by a post-transfer sheet guide SG2 and a sheet transport belt BH. The fixing region Q5 is a region (nip) where a heating roller Fh and a pressing roller Fp of a fixing device F are in contact with each other under pressure. When the recording sheet S is passed through the fixing region Q5, the toner image on the recording sheet S is heated and fixed by the fixing device F. The heating roller Fh is a heating member having a high surface energy as described above. The heating roller Fh is composed of, for example, a metal material.

Referring to FIGURE, a sheet transport roller 16 including a driving roller 16*a* and a driven roller 16*b*; a sheet transport roller Rb including a driving roller Rb1 and a driven roller Rb2; and a sheet output path SH2 are sequentially provided downstream of the fixing region Q5 where the toner image on the recording sheet S is fixed. The sheet output path SH2 is connected to a sheet reverse path SH3. A switching gate GT1 is provided at the junction between the sheet output path SH2 and the sheet reverse path SH3. The recording sheet S having been transported to the sheet output path SH2 is then transported to sheet output rollers Rh by the plural transport rollers Ra and output through a sheet exit Ka formed in a top end portion of the image forming apparatus U1 into a paper output tray TR3. The sheet reverse path SH3 is connected to a sheet circulation path SH4. A Mylar gate GT2 including a sheet-shaped member is provided at a portion where the sheet reverse path SH3 is connected to the sheet circulation path SH4. The Mylar gate GT2 lets the recording sheet S having been transported from the switching gate GT1 toward the sheet reverse path SH3 pass therethrough and directs the recording sheet S having passed therethrough and then having been returned thereto to the sheet circulation path SH4. The recording sheet S having been transported to the sheet circulation path SH4 is transported again to the transfer region Q4 through the paper feed path SH1. The elements denoted by the reference character numerals SH1 to SH4 constitute a sheet transport path SH. The sheet transport path SH and the rollers Ra, Rh, and the like that are provided in the sheet transport path SH and have the function of transporting sheets constitute a sheet transport device US.

By using a toner according to an exemplary embodiment for the image forming apparatus illustrated in FIGURE, a release agent having been discharged from the toner is uniformly spread over the heating roller Fh due to high affinity and migration of the release agent to the next recording sheet S on which a toner image has been subsequently fixed is reduced. As a result, contamination caused by the release agent in the sheet transport rollers 16 and Rb and the feed rollers Ra, Rh, and the like in the sheet transport device US that transport the post-image-formation recording sheets S on which toner images have been fixed. Thus, malfunction during continuous operation is suppressed.

EXAMPLES

Hereinafter, an exemplary embodiment will be described in detail with reference to examples. However, the exemplary embodiment is not restricted to these examples. In the following description, "part" represents "part by weight" unless otherwise specified.

Synthesis of Binding Resin

Dimethyl adipate: 74 parts
Dimethyl terephthalate: 192 parts
Ethylene oxide adduct of bisphenol A: 216 parts
Ethylene glycol: 38 parts
Tetrabutoxy titanate (catalyst): 0.037 parts These components were charged into a two-neck flask that had been heated and dried. A nitrogen gas was introduced into the flask. While this inert atmosphere of the flask was maintained and the solution in the flask was stirred, the solution was heated. Then, the solution was subjected to a condensation copolymerization reaction at 160° C. for 7 hours. After that, while the pressure in the flask was gradually decreased to 10 Torr, the reaction solution was heated to 220° C. and held for 4 hours. The reaction solution was temporarily brought to normal pressure and mixed with 9 parts of trimellitic anhydride. Then, the pressure was gradually decreased to 10 Torr again and held at 220° C. for an hour. Thus, a binding resin was synthesized.

Preparation of Resin Particle Dispersion Solution

Binding resin (Mw: 110,000): 160 parts

Ethyl acetate: 233 parts

Sodium hydroxide aqueous solution (0.3 N): 0.1 parts

These components were charged into a 1,000 ml separable flask, heated at 70° C., and stirred with a Three-one Motor (manufactured by Shinto Scientific Co., Ltd.) to prepare a resin mixture solution. While the resin mixture solution was stirred, 373 parts of ion-exchanged water was gradually added thereto to cause phase inversion and emulsification. By removing the solvent from the resultant solution, a resin particle dispersion solution (solid content concentration: 30%) was obtained.

Preparation of Molten Mixture (1) of Release Agent and Organic Silicon Compound

Paraffin wax (HNP-9 manufactured by NIPPON SEIRO CO., LTD., melting point: 75° C.): 40 parts Amino-modified silicone oil (KF-864 manufactured by Shin-Etsu Chemical Co., Ltd.): 10 parts These components were mixed together, heated at 95° C., and dispersed with a homogenizer (ULTRA-TURRAX T50 manufactured by IKA Japan) to prepare a molten mixture (1) of the release agent and the organic silicon compound.

Preparation of Molten Mixture (2) of Release Agent and Organic Silicon Compound

A molten mixture (2) of a release agent and an organic silicon compound was prepared as with the molten mixture (1) of the release agent and the organic silicon compound except that a silicone oil (KF-96-100 cs manufactured by Shin-Etsu Chemical Co., Ltd.) was used instead of the amino-modified silicone oil (KF-864 manufactured by Shin-Etsu Chemical Co., Ltd.).

Preparation of Molten Mixture (3) of Release Agent and Organic Silicon Compound

A molten mixture (3) of a release agent and an organic silicon compound was prepared as with the molten mixture (1) of the release agent and the organic silicon compound except that the amount of the amino-modified silicone oil (KF-864 manufactured by Shin-Etsu Chemical Co., Ltd.) was changed to 1.2 parts.

Preparation of Molten Mixture (4) of Release Agent and Organic Silicon Compound

A molten mixture (4) of a release agent and an organic silicon compound was prepared as with the molten mixture (1) of the release agent and the organic silicon compound except that the amount of the amino-modified silicone oil (KF-864 manufactured by Shin-Etsu Chemical Co., Ltd.) was changed to 21.5 parts.

Preparation of Molten Mixture (5) of Release Agent and Organic Silicon Compound

A molten mixture (5) of a release agent and an organic silicon compound was prepared as with the molten mixture (1) of the release agent and the organic silicon compound except that the amount of the amino-modified silicone oil (KF-864 manufactured by Shin-Etsu Chemical Co., Ltd.) was changed to 0.3 parts.

Preparation of Molten Mixture (6) of Release Agent and Organic Silicon Compound

A molten mixture (6) of a release agent and an organic silicon compound was prepared as with the molten mixture (1) of the release agent and the organic silicon compound except that the amount of the amino-modified silicone oil (KF-864 manufactured by Shin-Etsu Chemical Co., Ltd.) was changed to 26.7 parts.

Preparation of Release Agent Dispersion Solution (1)

Molten mixture (1) of release agent and organic silicon compound: 50 parts

Anionic surfactant (Neogen RK manufactured by DAI-ICHI KOGYO SEIYAKU CO., LTD.): 1.0 part Ion-exchanged water: 200 parts These components were mixed together, heated at 95° C., dispersed with a homogenizer (ULTRA-TURRAX T50 manufactured by IKA Japan), and subjected to a dispersion treatment with a Manton Gaulin high pressure homogenizer (manufactured by Gaulin Company) for 360 minutes to prepare a release agent dispersion solution (1) (solid content concentration: 20%) in which release agent particles having a volume average particle size of 0.23 μm were dispersed.

Preparation of Release Agent Dispersion Solution (2)

A release agent dispersion solution (2) (solid content concentration: 20%) in which release agent particles having a volume average particle size of 0.22 μm were dispersed was prepared as with the release agent dispersion solution (1) except that the molten mixture (2) of the release agent and the organic silicon compound was used instead of the molten mixture (1) of the release agent and the organic silicon compound.

Preparation of Release Agent Dispersion Solution (3)

A release agent dispersion solution (3) (solid content concentration: 20%) in which release agent particles having a volume average particle size of 0.23 μm were dispersed was prepared as with the release agent dispersion solution (1) except that the molten mixture (3) of the release agent and the organic silicon compound was used instead of the molten mixture (1) of the release agent and the organic silicon compound.

Preparation of Release Agent Dispersion Solution (4)

A release agent dispersion solution (4) (solid content concentration: 20%) in which release agent particles having a volume average particle size of 0.24 μm were dispersed was prepared as with the release agent dispersion solution (1) except that the molten mixture (4) of the release agent and the organic silicon compound was used instead of the molten mixture (1) of the release agent and the organic silicon compound.

Preparation of Release Agent Dispersion Solution (5)

A release agent dispersion solution (5) (solid content concentration: 20%) in which release agent particles having a volume average particle size of 0.22 μm were dispersed was prepared as with the release agent dispersion solution (1) except that the molten mixture (5) of the release agent and the organic silicon compound was used instead of the molten mixture (1) of the release agent and the organic silicon compound.

Preparation of Release Agent Dispersion Solution (6)

A release agent dispersion solution (6) (solid content concentration: 20%) in which release agent particles having a volume average particle size of 0.21 μm were dispersed was prepared as with the release agent dispersion solution (1) except that the molten mixture (6) of the release agent and the organic silicon compound was used instead of the molten mixture (1) of the release agent and the organic silicon compound.

Preparation of Release Agent Dispersion Solution (7)

A release agent dispersion solution (7) (solid content concentration: 20%) in which release agent particles having a volume average particle size of 0.22 μm were dispersed was prepared as with the release agent dispersion solution (1) except that paraffin wax (HNP-9 manufactured by NIPPON SEIRO CO., LTD., melting point: 75° C.) was used instead of the molten mixture (1) of the release agent and the organic silicon compound.

Preparation of Coloring Agent Particle Dispersion Solution

Cyan pigment (Pigment Blue 15:3 (copper phthalocyanine) manufactured by Dainichiseika Color & Chemicals Mfg. Co., Ltd.): 1,000 parts Anionic surfactant (Neogen R manufactured by DAI-ICHI KOGYO SEIYAKU CO., LTD.): 15 parts Ion-exchanged water: 9,000 parts These components were mixed together, dissolved, and dispersed with a high pressure impact dispersion apparatus Ultimizer (HJP30006 manufactured by SUGINO MACHINE LIMITED) for about an hour to prepare a coloring agent dispersion solution (solid content concentration: 10%) in which the coloring agent (cyan pigment) was dispersed.

PREPARATION OF TONERS

Toner for Example 1

Binding resin dispersion solution: 450 parts
Coloring agent dispersion solution: 21.74 parts
Release agent dispersion solution (1): 50 parts
Nonionic surfactant (IGEPAL CA897): 1.40 parts These raw materials were charged into a 2 L cylindrical stainless steel vessel and mixed together by being subjected to dispersion at 4,000 rpm under a shear force with a homogenizer (ULTRA-TURRAX T50 manufactured by IKA Japan) for 10 minutes. Then, 1.75 parts of 10% nitric acid aqueous solution of polyaluminum chloride serving as an agglomeration agent were gradually dropped into the resultant mixture and this mixture was mixed by being subjected to dispersion at 5,000 rpm with the homogenizer for 15 minutes to prepare a raw material dispersion solution.

After that, the raw material dispersion solution was moved to a polymerization tank equipped with a stirrer and a thermometer and heated with a mantle heater to promote growth of agglomeration particles at 42° C. At this time, the pH of the raw material dispersion solution was controlled within the range of 2.2 to 3.5 with a 0.3 N nitric acid and a 1N aqueous solution of sodium hydroxide. The raw material dispersion solution was held within the pH range for about 2 hours to form agglomeration particles. At this time, the volume average particle size of the agglomeration particles was measured with a Multisizer II (manufactured by Beckman Coulter, Inc., aperture size: 50 μm) and found to be 5.4 μm.

Then, 100 parts of the binding resin dispersion solution were additionally added to the raw material dispersion solution so that the resin particles of the binding resin were made to adhere to the surfaces of the agglomeration particles. The resultant solution was heated to 44° C. and the agglomeration particles were adjusted while the size and configuration of the agglomeration particles were checked with an optical microscope and the Multisizer II. After that, to fuse the agglomeration particles, the pH of the solution was increased to 8.0 and the solution was then heated to 95° C. After the fusion of the agglomeration particles was confirmed with the optical microscope, the pH of the solution was decreased to 6.0 while the solution was maintained at 95° C. After an hour elapsed, the heating was terminated and the solution was cooled at a cooling rate of 1.0° C./minute. After that, the solution was sifted through a 20 μm mesh. The resultant particles were repeatedly rinsed and dried with a vacuum dryer to provide toner particles. The toner particles had a volume average particle size of 6.2 μm.

Toner for Example 2

A toner for Example 2 was prepared as with the toner for Example 1 except that the release agent dispersion solution (2) was used instead of the release agent dispersion solution (1). The resultant toner particles had a volume average particle size of 6.1 μm.

Toner for Example 3

A toner for Example 3 was prepared as with the toner for Example 1 except that the release agent dispersion solution (3) was used instead of the release agent dispersion solution (1). The resultant toner particles had a volume average particle size of 6.1 μm.

Toner for Example 4

A toner for Example 4 was prepared as with the toner for Example 1 except that the release agent dispersion solution (4) was used instead of the release agent dispersion solution (1). The resultant toner particles had a volume average particle size of 6.1 μm.

Toner for Example 5

A toner for Example 5 was prepared as with the toner for Example 1 except that the release agent dispersion solution (5) was used instead of the release agent dispersion solution (1). The resultant toner particles had a volume average particle size of 6.1 μm.

Toner for Example 6

A toner for Example 6 was prepared as with the toner for Example 1 except that the release agent dispersion solution (6) was used instead of the release agent dispersion solution (1). The resultant toner particles had a volume average particle size of 6.1 μm.

Toner for Comparative Example 1

A toner for Comparative example 1 was prepared as with the toner for Example 1 except that the release agent dispersion solution (7) was used instead of the release agent dispersion solution (1). The resultant toner particles had a volume average particle size of 6.1 μm.

Preparation of Carriers

Ferrite particles (volume average particle size: 35 μm, GSDv: 1.20): 100 parts
Toluene: 14 parts
Polymethyl methacrylate-perfluorooctyl methyl acrylate copolymer (copolymerization ratio of 70:30, critical surface tension: 24 dyn/cm): 1.6 parts
Carbon black (product name: VXC-72, manufactured by Cabot Corporation, volume resistivity: 100 Ωcm or less): 0.12 parts
Crosslinked melamine resin particles (average particle size: 0.3 μm, insoluble in toluene): 0.3 parts The carbon black diluted with toluene was added to the polymethyl methacrylate-perfluorooctyl methyl acrylate copolymer and dispersed with a sand mill. Then, the above-described components other than the ferrite particles were dispersed in the resultant solution with a stirrer for 10 minutes to prepare a coating layer forming solution. Then, the coating layer forming solution and the ferrite particles were charged into a vacuum deaeration kneader and stirred at 60° C. for 30 minutes. Then, the resultant solution was brought under a reduced pressure to remove toluene. Thus, resin coating layers were formed and carriers were provided.

Preparation of Developer

Developers were prepared in the following manner: 36 parts of the toners for Examples 1 to 6 and the toner for Comparative example 1 and 414 parts of the carriers were charged into a 2 L V-blender, stirred for 20 minutes, and subsequently sifted through 212 μm mesh.

Fixing Rollers for Examples 1 to 6 and Comparative Example 1

Stainless steel pipes (metal tubes) having a diameter of 35 mm and a wall thickness of 2.0 mm were used, without being treated, as fixing rollers. The surface energy of these stainless steel members was $900\times10^{-3}$ N/m.

Fixing Roller for Example 7

An N-methyl-2-pyrrolidone solution containing a 20 wt % polyimide precursor was prepared by causing a reaction between 3,3',4,4'-biphenyltetracarboxylic dianhydride and 4,4'-diaminodiphenyl ether in N-methyl-2-pyrrolidone.

Then, while an aluminum pipe (metal tube) having a diameter of 35 mm and a wall thickness of 2.0 mm was rotated at 40 rpm with the axial direction of the pipe being kept horizontal, the polyimide precursor solution was dropped onto the outer circumferential surface of the aluminum pipe by discharging the polyimide precursor solution from a nozzle that had a diameter of 3 mm and was disposed immediately above the aluminum pipe at an air pressure of 0.8 MPa and at a flow rate of 12 ml/min. The solution having been dropped onto the outer circumferential surface of the aluminum pipe was leveled with a blade (formed of polyethylene, width: 20 mm, thickness: 1 mm) disposed so as to be pressed toward the outer circumferential surface of the aluminum pipe. In this state, the nozzle and the blade were simultaneously moved in the axial direction of the aluminum pipe at a rate of 60 mm/min to form a coating film on the surface of the aluminum pipe except for the regions having a width of 5 mm from the two ends of the pipe.

After the coating film was formed, the rotational rate of the aluminum pipe was changed to 6 rpm and, in this state, the coating film was heated and dried at 170° C. for 60 minutes. After that, the coating film was heated at 360° C. for 30 minutes to form a polyimide resin film. Thus, a polyimide resin film coated fixing roller was provided. The surface energy of the polyimide was $50\times10^{-3}$ N/m.

Fixing roller for Example 8

The surface of an aluminum pipe (metal tube) having a diameter of 35 mm and a wall thickness of 2.0 mm was subjected to pretreatments such as surface washing and prime coating, subsequently to powder coating with a powder coating material of a PFA resin (product name: MP-10, manufactured by E.I. du Pont de Nemours and Company), and repeatedly to firing steps and polishing steps in the peripheral direction. Thus, a fluorocarbon resin layer was formed and a fluorocarbon resin film coated fixing roller was provided. The surface energy of the fluorocarbon resin was $19\times10^{-3}$ N/m.

Evaluation of Toners

Analysis Method for Organic Silicon Compound in Release Agent

The organic silicon compounds in the release agents were analyzed by observation employing energy dispersive X-ray spectroscopy (EDX) and a scanning electron microscope (SEM) and by infrared absorption spectroscopy (IR analysis) in the following manner. Thus, the presence or absence of organic silicon compounds and the presence or absence of siloxane bonds in domains of the release agents were examined.

Each toner was embedded in an epoxy resin and a section of the embedded toner was prepared with a microtome so that the section was observed. The thus-prepared toner section was stained by a ruthenium staining technique. The stained section was observed with EDX and SEM to inspect the presence of Si element in wax domains identified by the staining.

In the analysis of the release agents by IR analysis, the presence of the absorption peak (1000 to 1100 $cm^{-1}$) of a Si—O—Si (siloxane) bond and the presence of the absorption peak (1200 to 1400 $cm^{-1}$) of a Si—$CH_3$ bond were examined.

Measurement of Contact Angles

The contact angles between the release agents being molten and the heating members (heating rollers) were measured in the following manner.

Each toner was dissolved in toluene heated at about 180° C. and then cooled and only the release agent having been crystallized was collected. The release agent was molten on the heating roller heated at a temperature equal to or higher than the melting point of the release agent. Thus, droplets of the release agent were formed on the heating roller and the contact angle was measured with a contact angle meter. At this time, the heating roller used was a heating roller of an external fixing device having a temperature regulation mechanism. The contact angle measured was a contact angle viewed in the processing direction (direction in which recording media are moved).

Evaluation with Actual Apparatus

For outputting images, a modified apparatus of a DocuCentre Color 500 (manufactured by Fuji Xerox Co., Ltd.) whose fixing device was changed to the above-described fixing device was used. In this apparatus, all the built-in developers were removed and the toners for Examples and Comparative example and the developers were charged into a toner cartridge for cyan and a developing unit. Thus, this apparatus was used as an evaluation test apparatus (hereafter, also referred to as "complex apparatus for evaluation"). For Examples 7 and 8, the same toner and developer as in Example 1 were used.

As a heating roller in the fixing device in the evaluation test apparatus, a heating roller constituted by the stainless steel fixing roller was attached for Examples 1 to 6 and Comparative example 1; a heating roller constituted by the polyimide resin film coated fixing roller was attached for Example 7; and a heating roller constituted by the fluorocarbon resin film coated fixing roller was attached for Example 8.

The paper sheets used were A4 paper sheets (C2 paper sheets manufactured by Fuji Xerox Co., Ltd.). For outputting images, printing tests were performed in the A4 transverse feed mode.

As for printed images for the evaluation, a test chart including solid images having dimensions of 1.2 cm by 17.0 cm (the longer side being in the output direction) in positions 4 cm, 14 cm, and 23 cm away from the top end portion of each A4 paper sheet in the longitudinal direction of the A4 paper sheet was output.

Misfeeding Proportion (Misfeeding Proportion Upon Continuous Printing of 10,000 Sheets)

The number of misfeeding occurred upon running of 10,000 A4 paper sheets for continuous printing was counted and the misfeeding proportion of this printing was calculated. A misfeeding proportion of 1.0% or less is allowable.

Wear Resistance (Brightness Unevenness Caused by Uneven Wear after Running of 40,000 Sheets for Printing)

While 40,000 A4 paper sheets were printed, a solid image was printed on a A3 paper sheet and the brightness unevenness of this solid image was evaluated in accordance with the following criteria.

Excellent: no brightness unevenness was observed after the printing of 40,000 sheets Good: brightness unevenness was observed after the printing of 30,000 to 40,000 sheets Fair: brightness unevenness was observed after the printing of 20,000 to 30,000 sheets Evaluation results of Examples 1 to 8 and Comparative example 1 are summarized in Table 1 below.

TABLE 1

| | Presence of siloxane bond in domain of release agent | Presence of amino group in organic silicon compound | Content of organic silicon compound (wt %) | Surface energy of heating member ($10^{-3}$ N/m) | Contact angle between release agent and heating member (°) | Misfeeding proportion (%) | Wear resistance |
|---|---|---|---|---|---|---|---|
| Example 1 | Present | Present | 1.49 | 900 | 5 | 0.01 | Excellent |
| Example 2 | Present | Absent | 1.49 | 900 | 19 | 0.05 | Excellent |
| Example 3 | Present | Present | 0.23 | 900 | 40 | 0.50 | Excellent |
| Example 4 | Present | Present | 2.88 | 900 | 30 | 0.08 | Excellent |
| Example 5 | Present | Present | 0.05 | 900 | 48 | 0.80 | Excellent |
| Example 6 | Present | Present | 3.05 | 900 | 35 | 0.10 | Excellent |
| Example 7 | Present | Present | 1.49 | 50 | 40 | 0.01 | Good |
| Example 8 | Present | Present | 1.49 | 19 | 60 | 0.01 | Fair |
| Comparative example 1 | Absent | Absent | 0.0 | 900 | 52 | 1.50 | Excellent |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic image developing toner comprising:

a binding resin;

a release agent having a melting point of about 70° C. to about 140° C. and a melt viscosity of 1 to 200 centipoises; and an organic silicon compound including a siloxane bond and having a molecular weight of about 100 to about 5,000, wherein:

the organic silicon compound is 0.1 to 3.0 wt % of the toner;

the release agent is 5 to 40 wt % of the toner; and the organic silicon compound is present in a domain of the release agent in the form of a composite of the organic silicon compound and the release agent.

2. The electrostatic image developing toner according to claim 1, wherein the organic silicon compound includes an amino group.

3. The electrostatic image developing toner according to claim 1, wherein the binding resin is a polyester resin having a softening point of about 90° C. to about 150° C.

4. The electrostatic image developing toner according to claim 1, wherein the binding resin has a weight average molecular weight of about 8,000 to about 150,000.

5. The electrostatic image developing toner according to claim 1, wherein the release agent comprises at least one member selected from the group consisting of paraffin waxes and derivatives thereof, montan waxes and derivatives thereof, microcrystalline waxes and derivatives thereof, Fischer-Tropsch waxes and derivatives thereof, and polyolefin waxes and derivatives thereof.

6. The electrostatic image developing toner according to claim 1, wherein the binding resin is a polyester resin synthesized by a polycondensation of a polyol component and a polycarboxylic acid component, wherein the polyol component is a polyhydric alcohol selected from the group consisting of polyoxypropylene(2.2)-2,2-bis(4-hydroxyphenyl)propane, polyoxyethylene(2.2)-2,2-bis(4-hydroxyphenyl) propane, 1,4-butanediol, and 1,3-butanediol.

7. The electrostatic image developing toner according to claim 1, wherein the organic silicon compound is a polydimethylsiloxane, a polymethyl phenyl siloxane, or an acrylsilicone copolymer.

8. The electrostatic image developing toner according to claim 1, wherein the organic silicon compound includes an amino group, an epoxy group, a hydroxyl group, a carboxyl group, a methacrylic group, or a sulfo group.

9. The electrostatic image developing toner according to claim 1, wherein the composite is formed by melting and mixing the release agent and the organic silicon compound under a shear force.

* * * * *